United States Patent [19]

Bartel et al.

[11] 4,388,053

[45] Jun. 14, 1983

[54] FUEL FEED PUMP

[75] Inventors: Günter Bartel, Stuttgart; Eckhard Patz, Waiblingen; Karl Koch, Fellbach; Georg Stern, Sindelfingen; Manfred Stotz, Aichwald; Adolf Triffterer, Nuertingen, all of Fed. Rep. of Germany

[73] Assignee: Daimler-Benz Aktiengesellschaft, Stuttgart, Fed. Rep. of Germany

[21] Appl. No.: 232,815

[22] Filed: Feb. 9, 1981

[30] Foreign Application Priority Data

Feb. 7, 1980 [DE] Fed. Rep. of Germany ..... 3004458

[51] Int. Cl.[3] ..... F04B 11/00

[52] U.S. Cl. ..... 417/542; 222/263; 123/447

[58] Field of Search ..... 417/540, 542, 541, 543; 222/263, 335; 123/447, 516, 510, 472, 478

[56] References Cited

U.S. PATENT DOCUMENTS

| | | | |
|---|---|---|---|
| 3,192,864 | 7/1965 | Notte | 417/540 |
| 3,422,807 | 1/1969 | Waldecker | 222/335 X |
| 3,763,840 | 10/1973 | Schimmelpfenig | 137/469 |
| 4,207,033 | 6/1980 | Drutchas et al. | 417/540 X |

FOREIGN PATENT DOCUMENTS

| | | | |
|---|---|---|---|
| 699222 | 11/1979 | U.S.S.R. | 123/447 |

*Primary Examiner*—Carlton R. Croyle
*Assistant Examiner*—Donald E. Stout
*Attorney, Agent, or Firm*—Craig & Burns

[57] ABSTRACT

A fuel feed pump arrangement which includes a housing serving for accommodating both an electric motor and a feed pump system coupled to the electric motor. A diaphragm is provided in the housing with the diaphragm maintaining a system pressure for a predetermined period of time after the drive motor of the pump system has been turned off.

13 Claims, 1 Drawing Figure

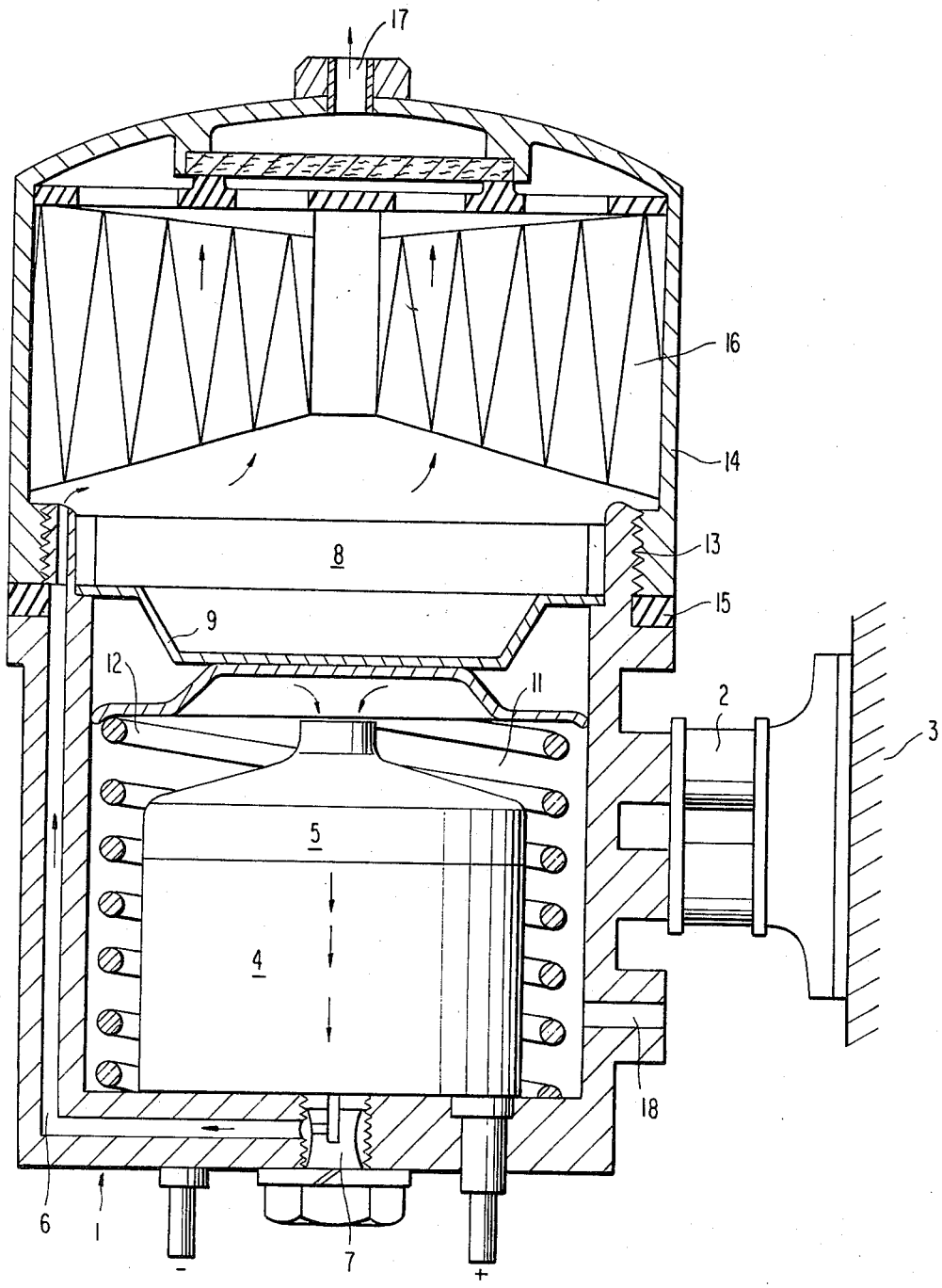
17
16
14
13
15
8
9
12
11
2
3
5
4
18
6
1
7
-
+

FUEL FEED PUMP

The present invention relates to a pump arrangement and, more particularly, to a fuel feed pump which is provided with a housing which serves to accommodate both an electric motor and a pump system coupled therewith.

A fuel feed pump of the aforementioned type is proposed in, for example, Offenlegungsschrift No. 27 45 800.

The aim underlying the present invention essentially resides in providing a fuel feed pump arrangement which is adapted to maintain a pressure in a fuel conduit system leading to an engine for a predetermined period of time so that, in this predetermined period of time, after a turning off of the engine and restarting the same, fuel is immediately available to the engine, whereby the engine starts up without an undue taxing of the battery by the starter.

In accordance with advantageous features of the present invention, a common housing is provided for accommodating both the fuel feed pump and the electric motor, the diaphragm being disposed in the common housing, which diaphragm maintains the required pressure in the fuel conduit system for a certain period of time after the electric motor and the pump have been shut off.

Advantageously, in accordance with further features of the present invention, one side of the diaphragm is exposed to a pressure and the diaphragm, in turn, exerts a pressure on a coil spring surrounding the electric drive motor and the fuel pump.

In order to enable the realization of not only an extremely compact structure but also to enable a ready assembly of the fuel feed pump, a conduit extending from a pressure site outlet of the unit formed by the drive motor and pump to a pressure chamber of the diaphragm is disposed within a wall of the housing.

In accordance with the present invention, a cap may be threadedly attached to the housing, with a filter being accommodated in the cap.

In order to provide a shock-absorbing support for the housing of the fuel feed pump, advantageously, in accordance with further features of the present invention, the housing may be attached by way of a rubber-metal element to a bearing part forming, for example, a body part of a motor vehicle or a part of an internal combustion engine of the motor vehicle.

Accordingly, it is an object of the present invention to provide a fuel feed pump arrangement, especially for a motor vehicle, which avoids, by simple means, shortcomings and disadvantages encountered in the prior art.

Another object of the present invention resides in providing a fuel feed pump arrangement, especially for a motor vehicle, which minimizes the number of structural parts necessary to ensure an efficient feeding of fuel to an engine of the motor vehicle.

Yet another object of the present invention resides in providing a fuel feed pump arrangement which enables a combining of the structural parts thereof into a common housing so as to minimize not only the installation space required, but also minimize the total weight of the fuel feed pump.

A further object of the present invention resides in providing a fuel feed pump arrangement which is simple in construction and therefore relatively inexpensive to manufacture.

A still further object of the present invention resides in providing a fuel feed pump arrangement, especially for a motor vehicle, which functions reliably under all operating conditions.

Yet another object of the present invention resides in providing a fuel feed pump arrangement, especially for motor vehicles, which maintains a predetermined fuel feed pressure in the fuel supply system of the motor vehicle over a predetermined time period after the feed pump arrangement has been shut off.

These and other objects, features, and advantages of the present invention will become more apparent from the following description when taken in connection with the accompanying drawing which shows, for the purposes of illustration only, one embodiment in accordance with the present invention, and wherein:

The single FIGURE of the drawing is a partially schematic longitudinal cross-sectional view of a fuel feed pump arrangement for a motor vehicle constructed in accordance with the present invention.

Referring now to the single FIGURE of the drawing, according to this FIGURE, a housing generally designated by the reference numeral 1 of a fuel feed pump is adapted to be attached by a rubber-metal element 2, of a conventional construction, to a bearing part 3 of a motor vehicle (not shown). The housing 1 accommodates an electric drive motor 4 and a fuel pump system 5 coupled thereto. A connecting conduit or line 6 is formed in a wall of the housing 1, with the conduit or line 6 extending from an outlet 7, disposed on a pressure side of the unit formed by the drive motor 4 and pump system 5, to a pressure chamber 8.

A diaphragm 9 is provided for sealing off the pressure chamber 8 from the portion of the housing 1 accommodating the unit formed by the drive motor 4 and pump system 5. The portion of the housing on the other side of the diaphragm 9 accommodating the drive motor 4 and pump system 5 is formed as a vacuum or suction chamber 11. A helical compression spring 12 surrounds the unit formed by the electric drive motor 4 and pump system 5 and is arranged in the chamber 11 with the diaphragm resting against the helical compression spring 12.

A marginal zone or area of the housing 1, surrounding the pressure chamber 8, is provided with a threaded portion 13 which is adapted to threadably secure a cap 14 to the housing 1. A sealing ring 15 is interposed between a flange of the housing 1 and an end of the cover 14 so as to enable a sealing of the housing 1. The cap 14 accommodates a filter 16 and includes a filter outlet opening 17.

The fuel feed pump of the present invention operates in the following manner.

The pump system 5, driven by the electric drive motor 4, takes in fuel from a fuel storage means such as, for example, a fuel tank (not shown) of the motor vehicle, through an intake line or conduit 18 and conveys the fuel through the connecting conduit or line 6 into the pressure chamber 8. During the process, the diaphragm 9 is moved against the biasing force of the helical compression spring 12 in a direction of the chamber 11, i.e., toward the unit formed by the electric drive motor 4 and the pump system 5, and an excess pressure of about 5.4 bar is produced in the pressure chamber 8. Even upon a deactivation of the fuel feed pump, a pressure of about 3 bar is maintained by virtue of the biasing force of the helical compression spring 12.

As can be appreciated, by a proper selection of the biasing force of the helical compression spring 12, the pressure drop over a given time period can be readily controlled. For example, with an excess pressure of 5.4 bar and a pressure of about 3 bar following deactivation of the fuel feed pump, by virtue of the biasing force of the helical compression spring 12, after a period of 1½ hours, the pressure may drop to about 0.2 bar and, even in such a situation, it is still ensured that the internal combustion engine will immediately start up once again since fuel is available at once. Additionally, the fuel feed pump according to the present invention is lightweight and compact and thus can be accommodated without difficulties anywhere within the motor vehicle and even in restricted mounting spaces.

While we have shown and described only one embodiment in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

We claim:

1. A fuel feed pump arrangement adapted to be connected to a fuel conduit system, the fuel feed pump arrangement comprising an electric drive motor means, a fuel pump system coupled to the drive motor means, and a common housing means for accommodating both the drive motor means and the fuel pump system, a diaphragm means disposed in the housing means for maintaining a pressure in the fuel conduit system for a predetermined period of time after the drive motor of the pump system has been turned off, the diaphragm means dividing the housing means into a pressure chamber and a vacuum chamber, the electric drive motor means and feed pump system disposed in the vacuum chamber, means for supplying a pressure to the pressure chamber so as to expose the diaphragm means to the pressure, a spring means disposed in the vacuum chamber, a diaphragm means pressing against the spring means when exposed to the pressure in the pressure chamber, the spring means comprises a coil spring which surrounds the electric drive motor means and the feed pump system.

2. A fuel feed pump arrangement according to claim 1, characterized in that the pressure supply means includes a conduit means extending from a pressure side outlet of the feed pump system to the pressure chamber.

3. A fuel feed pump arrangement according to claim 2, characterized in that the conduit means is disposed within a wall of the housing means.

4. A fuel feed pump arrangement according to claim 3, characterized in that a cap means is provided for closing the housing means.

5. A fuel feed pump arrangement according to claim 4, characterized in that a filter means is accommodated in the cap means.

6. A fuel feed pump arrangement according to claim 5, characterized in that a fuel outlet opening communicating with the fuel conduit system is disposed in the cap means.

7. A fuel feed pump arrangement according to claim 6, characterized in that means are provided on the housing means and the cap means for enabling a threadable attachment of the cap means with the housing means.

8. A fuel feed pump arrangement according to claim 7, characterized in that shock-absorbing means are provided on the housing means for enabling an attachment of the housing means to a bearing part.

9. A fuel feed pump arrangement according to claim 8, characterized in that the shock-absorbing means is formed as a rubber-metal element.

10. A fuel feed pump arrangement according to claim 1, characterized in that a cap means is provided for closing the housing means.

11. A fuel feed pump arrangement according to claim 10, characterized in that a filter means is accommodated in the cap means.

12. A fuel feed pump arrangement according to claim 11, characterized in that a fuel outlet opening communicating with the fuel conduit system is disposed in the cap means.

13. A fuel feed pump arrangement according to claim 1, characterized in that shock-absorbing means are provided on the housing means for enabling an attachment of the housing means to a bearing part.

* * * * *